US009453473B2

(12) United States Patent
Lehner et al.

(10) Patent No.: US 9,453,473 B2
(45) Date of Patent: Sep. 27, 2016

(54) METHOD FOR ACTUATING A PIEZO INJECTOR OF A FUEL INJECTION SYSTEM

(75) Inventors: Steffen Lehner, Eichstätt (DE); Robert Hoffmann, Ruhstorf/Rott (DE); Hans-Jörg Wiehoff, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 875 days.

(21) Appl. No.: 13/820,778

(22) PCT Filed: Aug. 24, 2011

(86) PCT No.: PCT/EP2011/064575

§ 371 (c)(1),
(2), (4) Date: May 28, 2013

(87) PCT Pub. No.: WO2012/031898

PCT Pub. Date: Mar. 15, 2012

(65) Prior Publication Data

US 2013/0239929 A1 Sep. 19, 2013

(30) Foreign Application Priority Data

Sep. 7, 2010 (DE) ..... 10 2010 040 306

(51) Int. Cl.
*F02D 41/30* (2006.01)
*F02D 41/20* (2006.01)
*F02M 51/06* (2006.01)

(52) U.S. Cl.
CPC ..... *F02D 41/3005* (2013.01); *F02D 41/2096* (2013.01); *F02D 2200/0602* (2013.01); *F02D 2250/04* (2013.01); *F02M 51/0603* (2013.01)

(58) Field of Classification Search
CPC ..... F02M 51/06; F02M 51/0603; F02M 61/161; F02M 63/0026; F02M 2200/21; F02D 41/20; F02D 2041/2003; F02D 2041/2017; F02D 2041/202; F02D 2041/2037; F02D 41/30; F02D 41/3005; F02D 41/2096
See application file for complete search history.

(56) References Cited

U.S. PATENT DOCUMENTS 4,669,440 A * 6/1987 Takase ..... F02D 41/20 123/478
6,147,433 A 11/2000 Reineke et al. ..... 310/316.03

(Continued)

FOREIGN PATENT DOCUMENTS

CN 101755116 A 6/2010 ..... F02D 41/20
DE 19733560 A1 2/1999 ..... F02D 41/20

(Continued)

OTHER PUBLICATIONS

Melhfeldt, Dirk, "Modellierung und Optimale Steuerung Piezoelektrisch Aktuierter Einspritzventile," XP55012076, URL: http/d-nb.info/980320844/32, 13 pages (w/ English abstract), Jun. 9, 2006.
International Search Report and Written Opinion, Application No. PCT/EP2011/064575, 13 pages, Dec. 2, 2011.

*Primary Examiner* — Erick Solis
*Assistant Examiner* — Anthony L Bacon
(74) *Attorney, Agent, or Firm* — Slayden Grubert Beard PLLC

(57) ABSTRACT

A method for actuating a piezoelectric actuator and a piezo injector of a fuel injection system having a nozzle needle which can be moved between the closed position and an open position by the piezoelectric actuator are disclosed. Current is applied to the piezoelectric actuator from a source for the duration of a charging time as a function of a required quantity of fuel, in order to move the nozzle needle into its opened position for a time period which is dependent on the required quantity of fuel. The charging time is selected according to the following relationships: $t_{charge}(p)=t_{nom,charge}(p)$ for $TI>t_{EP,p}$ and $t_{charge}(p, TI)\leq Ti$ for $TI\leq t_{EP,p}$.

3 Claims, 3 Drawing Sheets

(56) References Cited

U.S. PATENT DOCUMENTS

| | | | | |
|---|---|---|---|---|
| 8,239,115 | B2 | 8/2012 | Ascher et al. | 701/103 |
| 8,365,704 | B2 | 2/2013 | Beilharz et al. | 123/480 |
| 2008/0265805 | A1* | 10/2008 | Pirkl | F02D 41/2096 318/116 |
| 2010/0063709 | A1* | 3/2010 | Ascher | F02D 41/2096 701/103 |
| 2011/0042594 | A1* | 2/2011 | Chassagnoux | F01L 9/04 251/129.01 |
| 2013/0239929 | A1 | 9/2013 | Lehner et al. | 123/478 |

FOREIGN PATENT DOCUMENTS

| | | | | |
|---|---|---|---|---|
| DE | 19921456 | A1 | 11/2000 | F02D 41/20 |
| DE | 102004062073 | A1 | 7/2006 | F02D 41/20 |
| EP | 0371469 | A2 | 6/1990 | F02D 41/20 |
| EP | 1172541 | A1 | 1/2002 | F02D 41/20 |
| WO | 03/083278 | A1 | 10/2003 | F02D 41/20 |
| WO | 2012/031898 | A1 | 3/2012 | F02D 41/20 |

* cited by examiner

METHOD FOR ACTUATING A PIEZO INJECTOR OF A FUEL INJECTION SYSTEM

CROSS-REFERENCE TO RELATED APPLICATIONS

This application is a U.S. National Stage Application of International Application No. PCT/EP2011/064575 filed Aug. 24, 2011, which designates the United States of America, and claims priority to DE Application No. 10 2010 040 306.7 filed Sep. 7, 2010, the contents of which are hereby incorporated by reference in their entirety.

TECHNICAL FIELD

The disclosure relates to a method for actuating a piezo injector of a fuel injection system.

BACKGROUND

In a fuel injection system of this type, the piezo injector has a piezoelectric actuator and a nozzle needle which can be moved by the piezoelectric actuator. The piezoelectric actuator is actuated by means of an electrical actuation signal. On the basis of this actuation signal, the piezoelectric actuator is lengthened in such a way that a mechanical reciprocal movement is brought about. This reciprocal movement moves the nozzle needle by means of which injection holes in a nozzle unit are opened to a greater or lesser extent, in order to be able to inject a desired quantity of fuel, dependent on the specified electrical actuation signal, through the piezo injector into a cylinder of the respective motor vehicle. When the nozzle needle moves, it can arrive at its mechanically predefined needle stroke limitation, i.e. at its needle stop position.

If the electrical actuation of the piezo injector takes place in such a way that the charging time lasts up to the start of the discharging, it is then possible, given a predefined pressure, for various opening times in the chronological vicinity of the needle stop to provide the same quantity of fuel, with the result that there is an ambiguity present in the injection quantity/injection period characteristic diagram. In this context, the injected quantity of fuel can also drop given an increase in opening time. The reason for this is bouncing of the nozzle needle at the stop and the associated different closing speeds dependent on the actuation signal. The term opening time is understood below always to mean the time period which starts with the activation of the injector drive, i.e. the charging of the piezo actuator for the purpose of opening the injection holes, and ends with the start of deactivation of the injector drive, i.e. the discharging of the piezo actuator for the purpose of closing the injection holes.

The specified ambiguity in the injection quantity/injection period characteristic diagram is illustrated in FIG. 1. This shows a diagram in which the injection period TI is plotted along the abscissa and the injection quantity Q is plotted along the ordinate. From this diagram it is apparent that when a pressure value p=1200 bar is present a requested injection quantity of 16 $mm^3$ with three different injection periods t1, t2 and t3 can be implemented, wherein in the exemplary embodiment shown t1=0.34 ms, t2=0.36 ms and t3=0.42 ms.

In the case of TI=t1=0.34 ms, the piezo actuator is energized for 0.34 ms, with the result that the nozzle needle does not yet bounce or bounces only very little at the stop and then closes.

In the case of TI=t2=0.36 ms, the piezo actuator is energized for 0.35 ms, which gives rise to strong bouncing. This bouncing accelerates the closing process to such an extent that despite a relatively long opening time no additional quantity of fuel is injected.

In the case of TI=t3=0.42 ms, the injection period is just long enough to equalize the bouncing back of the needle through an extended opening time.

In this example in which the pressure p is 1200 bar, the piezo actuator is lengthened in the time interval between TI=0.4 ms and TI=0.6 ms to such an extent that the piezo injector opens again completely from TI=0.6 ms. This is the cause of the high gradient starting from the minimum. From approximately TI=0.6 ms, the piezo injector is finally completely throttled, as a result of which the injection quantity only then depends on the injection period.

Owing to the fact that there is no clear relationship between the injection quantity Q and the injection period TI, a plurality of injection periods can be assigned to one requested quantity of fuel. Consequently, it is not possible to regulate the injection quantity with the injection period as a manipulated variable. A regulator would not regulate in a robust fashion in the surroundings of the needle stop but rather tend to swing.

The specified ambiguity in the injection quantity/injection period characteristic diagram is caused by the impetus of the nozzle needle which causes the nozzle needle to recoil somewhat as a result of striking against the needle stroke limitation or the needle stop position. This impetus is determined by the energy applied to the nozzle needle, which energy depends directly on the current and charging time of the needle drive given a predefined actuation power. The charging time describes the time during which the drive, i.e. the piezo actuator, is energized.

For the so-called full stroke operating mode, the nominal charging time $t_{nom,charge}$ of the drive is dimensioned to open the piezo injector at a given current in such a way that the needle reliably reaches its stop position. Said needle is at maximum several 100 μs and is independent of relatively long opening times. If relatively short opening times are desired, the charging time is set to be equal to the opening time. The form of the charging current is independent of the charging time. The charging current is cut off at the end of the charging time.

In the case of the known method described above for actuating a piezo injector the following relationships apply:

$$t_{charge}(p)=t_{nom,charge}(p) \text{ for } TI \geq t_{nom,charge} \quad \text{(equation 1)}$$

$$t_{charge}(p)=TI \text{ for } TI<t_{nom,charge} \quad \text{(equation 2).}$$

It is already known to counteract bouncing and the ambiguity of the injection quantity/injection period characteristic diagram caused thereby through long actuation times given a low actuation power.

As a result, the speed of the nozzle needle is reduced, which in turn reduces the bouncing of the nozzle needle at the needle stroke limitation. Furthermore, part of the energy is applied only after the needle stroke limitation has been reached. In such a procedure, the bouncing can be reduced sufficiently only for very low actuation power levels and long actuation times associated therewith.

Further disadvantages of such a slow energy supply, i.e. a long charging time of the piezo actuator, are, in particular, the slow passage through the seat throttling and the late acquisition of the energy which is necessary for completely dethrottling or reaching the needle stop. Furthermore, in the case of such a reduction in the bouncing the strength of an important signal, namely the needle stop signal, is reduced. This makes detection of the striking of the needle against its stop position more difficult. A further disadvantage of such a slow supply of energy is the fact that the needle remaining for a long time in the throttling makes reaching the requested minimum quantity accuracy more difficult.

SUMMARY

One example embodiment provides a method for actuating a piezo injector, having a piezoelectric actuator and a nozzle needle which can be moved by the piezoelectric actuator between a closed position and an open position, of a fuel injection system, in which current is applied to the piezoelectric actuator by a source for the duration of a charging time as a function of a requested quantity of fuel in order to move the nozzle needle into its open position for a time period dependent on the requested quantity of fuel, characterized in that the charging time is selected according to the following relationships:

$$t_{charge}(p)=t_{nom,charge}(p) \text{ for } TI>t_{EP,p}$$

and $$t_{charge}(p,TI)\leq TI \text{ for } TI\leq t_{EP,p},$$

where $t_{nom,charge}$ (p) is the nominal charging time given a pressure p, TI is the opening time for the piezo injector and $t_{EP,p}$ is the end time of the influence of the bouncing in the case of the pressure p.

BRIEF DESCRIPTION OF THE DRAWINGS

Exemplary embodiments will be explained in more detail below based on the schematic drawings, wherein.

DETAILED DESCRIPTION

Embodiments of the present disclosure provide an improved method for actuating a piezo injector of a fuel injection system.

Figure 2:
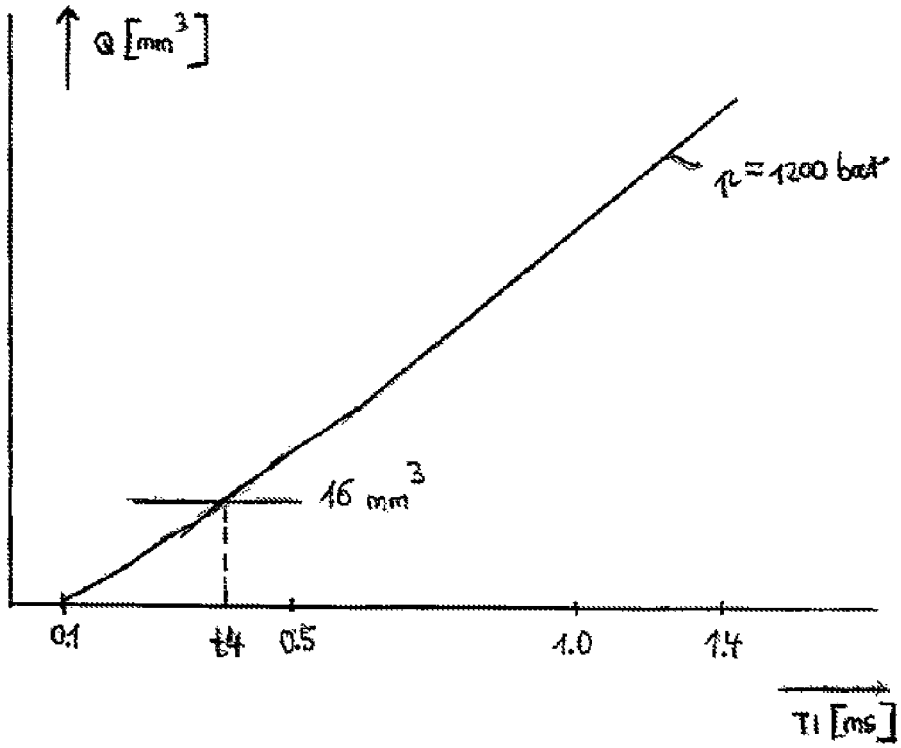
FIG. 2 illustrates a plot of injection quantity as a function of the injection period for a fuel injector according to an example embodiment of the present invention.
Figure 3:
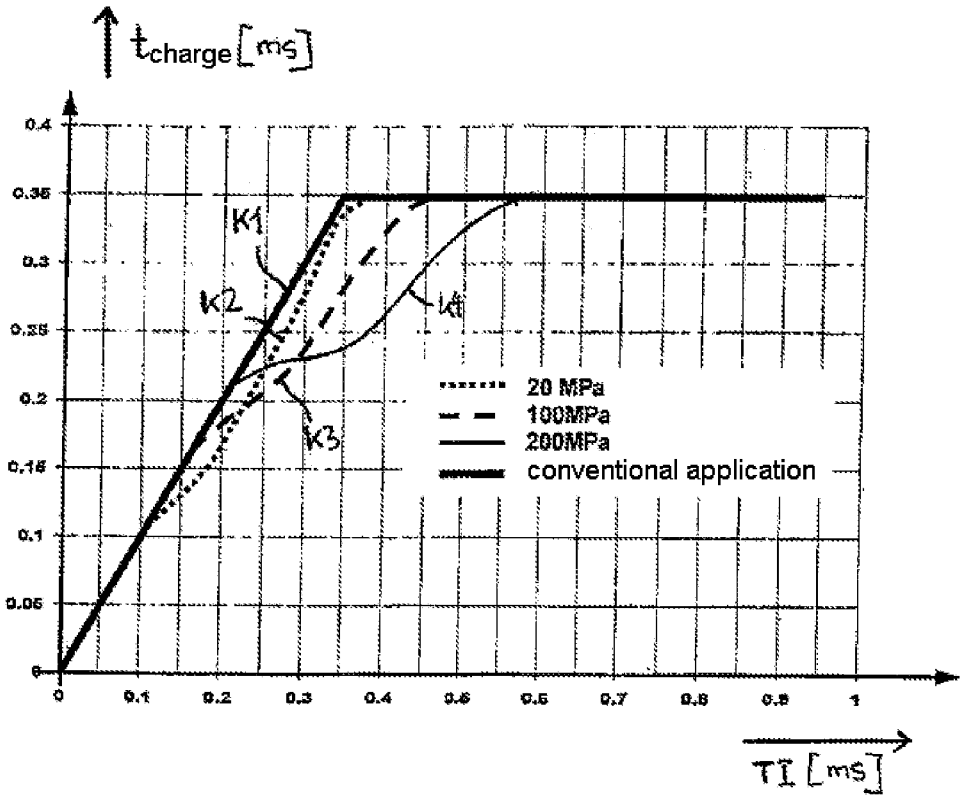
FIG. 3 illustrates a plot of charging time as a function of the injection period for a fuel injector for different pressures according to an example embodiment of the present invention, and for comparison to a conventional technique.

FIG. 2 shows a diagram in which the injection quantity is plotted as a function of the injection period when the disclosed method is used. FIG. 3 shows a diagram in which the charging time is plotted as a function of the injection period.

Figure 1:
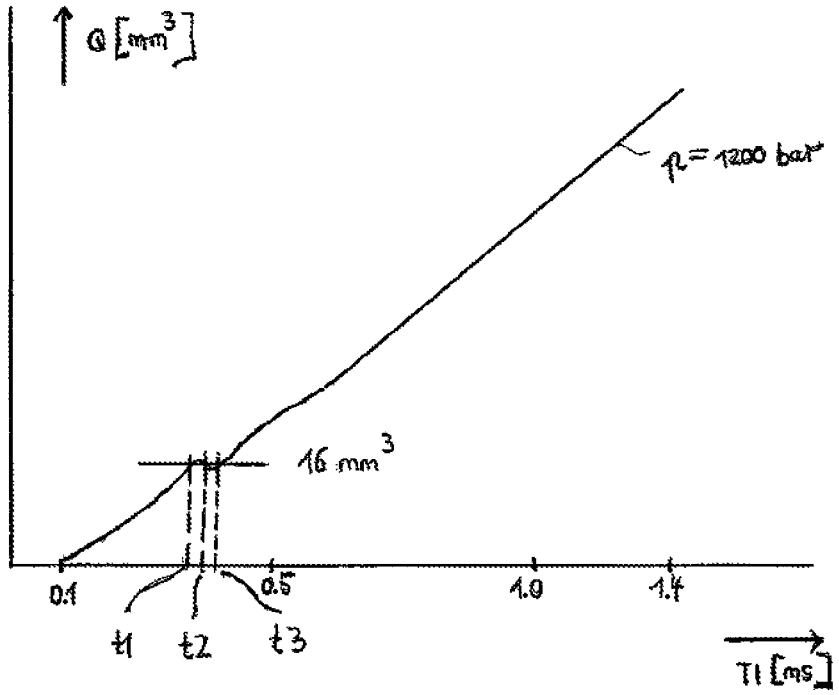
FIG. 1 illustrates a plot of injection quantity as a function of the injection period for a fuel injector according to conventional techniques.

FIG. 2, like FIG. 1, shows a diagram in which the injection period TI is plotted along the abscissa and the injection quantity Q is plotted along the ordinate. From this diagram it is apparent that when a pressure value p=1200 bar is present a requested fuel quantity of 16 $mm^3$ is assigned to a single injection period t4, which is 0.4 ms in the exemplary embodiment shown. This may be achieved by a control device configured to control the piezo actuator, in particular by selecting or controlling the charging time for applying current to the piezo actuator, according to the following relationships for the charging time:

$$t_{charge}(p)=t_{nom,charge}(p) \text{ for } TI>t_{end\ influence\ of\ bounce(p)} \quad \text{(equation 3)}$$

$$t_{charge}(p,TI)\leq TI \text{ for } TI\leq t_{end\ influence\ of\ bounce(p)} \quad \text{(equation 4).}$$

Using these relationships permits free controllability of the fed-in energy and therefore of the needle impetus to be achieved by dynamically adapting the charging time of the drive as a function of the requested opening time and the respectively given pressure. The present disclosed technique refrains from equating the charging time and the opening time for all the opening times which are shorter than the nominal charging time, as is used in known methods.

When the disclosed relationships are used it may be possible for the charging time to be set to its maximum, specifically the nominal charging time, only for very long opening times.

Furthermore, when the disclosed relationships are used the injection quantity/injection period characteristic diagram can be linear because specifically in the transition region to the full stroke a considerable increase in the opening period is added to an increase in the impetus. Consequently, the needle stroke which is reduced by the bouncing is compensated by a lengthened opening period. This results in the injection quantity rising continuously with the opening period. This brings about clarity in the injection quantity/injection period characteristic diagram.

Further potential advantages include reduction of the actuation power level of the piezo actuator and/or reduction of the mechanical loading thereof at the respective operating point, which may promote an increased service life.

In addition, when relatively small fuel quantities are applied the system sensitivity may be reduced.

Furthermore, the shot-to-shot variation may be reduced due to the increasing of the dethrottling time.

Finally, the injector-to-injector variation may be reduced due to the increasing of the dethrottling time.

FIG. 3 shows a diagram in which the injection time TI is plotted along the abscissa and the charging time $t_{charge}$ is plotted along the ordinate.

The curve K1 corresponds to an actuation according to a conventional technique, wherein in the exemplary embodiment shown, the following applies:

$$t_{charge}=TI \text{ for } TI\leq t_{nom,charge};\ t_{nom,charge}=0.35 \text{ ms};$$

$$t_{charge}=t_{nom,charge} \text{ for } TI>t_{nom,charge};\ t_{nom,charge}=0.35 \text{ ms.}$$

The curves K2, K3 and K4 correspond to curve profiles such as are applied for use when the disclosed method is used.

Curve 2 corresponds to a curve profile in the case of a pressure p=20 MPa. The curve K3 corresponds to a curve profile in the case of a pressure p=100 MPa. The curve K4 corresponds to a curve profile in the case of a pressure p=200 MPa.

From the profiles of the curves K2, K3 and K4 it is apparent that in a transition region between a linear rise in the curve at which $t_{charge}$ (p,TI)=TI and a constant profile of the curve at which $t_{charge}$ is constantly at 0.35 ms, a transition region is present in which the curves K2, K3 and K4 have a different profile dependent on the pressure p. These curve profiles are determined by the manufacturer of the piezo injector on the basis of the examinations of a reference piezo injector on a system test bench such that linearization of the curve profile permits the ambiguity of the injection quantity/injection period characteristic diagram shown in FIG. 1 to be eliminated.

Curves K2, K3 and K4 illustrate the free controllability, given with the claimed method, of the energy fed into the piezo actuator and therefore of the needle impetus through dynamic adaptation of the charging time of the drive, in particular as a function of the requested opening time and of the given pressure. Specifically in the transition region between the constantly rising profile of the respective curve and the constant profile thereof, i.e. in the transition region with a full stroke operating mode, a considerable increase in the injection period or the opening period is added to the increase in the impetus.

What is claimed is:

1. A method for actuating a piezo injector of a fuel injection system, the piezo injector having a piezoelectric actuator and a nozzle needle configured for movement by the piezoelectric actuator between a closed position and an open position, comprising:

applying current to the piezoelectric actuator from a source for the duration of a charging time selected as a function of a requested quantity of fuel to move the nozzle needle into the open position for a time period dependent on the requested quantity of fuel, wherein the charging time is selected according to the following relationships:

$$t_{charge}(p)=t_{nom,charge}(p) \text{ for } TI>t_{EP,p} \text{ and}$$

$$t_{charge}(p,TI)\leq Ti \text{ for } TI\leq t_{EP,p},$$

where $t_{nom,charge}$ (p) is a nominal charging time given a pressure p, TI is an opening time for the piezo injector and $t_{EP,p}$ is an end time of an influence of bouncing for the pressure p.

2. A control system for a piezo injector having a piezoelectric actuator and a nozzle needle configured for movement by the piezoelectric actuator between a closed position and an open position, comprising:

a current source configured to supply current to the piezoelectric actuator, and a control device configured to control a charging time during which the current source applies current to the piezoelectric actuator, wherein the charging time is selected as a function of a requested quantity of fuel to move the nozzle needle into the open position for a time period dependent on the requested quantity of fuel, and wherein the charging time is selected according to the following relationships:

$$t_{charge}(p)=t_{nom,charge}(p) \text{ for } TI>t_{EP,p} \text{ and}$$

$$t_{charge}(p,TI)\leq Ti \text{ for } TI\leq t_{EP,p},$$

where $t_{nom,charge}$ (p) is a nominal charging time given a pressure p, TI is an opening time for the piezo injector and $t_{EP,p}$ is an end time of an influence of bouncing for the pressure p.

3. A fuel injector system, comprising:

a piezo injector comprising a piezoelectric actuator and a nozzle needle configured for movement by the piezoelectric actuator between a closed position and an open position, a current source configured to supply current to the piezoelectric actuator, and a control device configured to control a charging time during which the current source applies current to the piezoelectric actuator, wherein the charging time is selected as a function of a requested quantity of fuel to move the nozzle needle into the open position for a time period dependent on the requested quantity of fuel, and wherein the charging time is selected according to the following relationships:

$$t_{charge}(p)=t_{nom,charge}(p) \text{ for } TI>t_{EP,p}$$

and $$t_{charge}(p,TI)\leq Ti \text{ for } TI\leq t_{EP,p},$$

where $t_{nom,charge}$ (p) is a nominal charging time given a pressure p, TI is an opening time for the piezo injector and $t_{EP,p}$ is an end time of an influence of bouncing for the pressure p.

* * * * *